US005732679A

United States Patent [19]

Takahasi et al.

[11] Patent Number: 5,732,679

[45] Date of Patent: Mar. 31, 1998

[54] ACCUMULATOR-TYPE FUEL INJECTION SYSTEM

[75] Inventors: Susumu Takahasi; Terukazu Nishimura, both of Fujisawa, Japan

[73] Assignee: Isuzu Motors Limited, Tokyo, Japan

[21] Appl. No.: 633,632

[22] Filed: Apr. 17, 1996

[30] Foreign Application Priority Data

Apr. 27, 1995 [JP] Japan ..... 7-103961
Apr. 28, 1995 [JP] Japan ..... 7-106048

[51] Int. Cl.[6] ..... F02M 37/04

[52] U.S. Cl. ..... 123/467; 123/447

[58] Field of Search ..... 123/467, 447, 123/446, 514, 357, 496

[56] References Cited

U.S. PATENT DOCUMENTS

| | | | |
|---|---|---|---|
| 4,603,671 | 8/1986 | Yoshinaga et al. . | |
| 4,719,889 | 1/1988 | Amann | 123/467 |
| 4,784,101 | 11/1988 | Iwanaga | 123/467 |
| 5,012,786 | 5/1991 | Voss | 123/467 |
| 5,156,132 | 10/1992 | Iwanaga | 123/467 |
| 5,511,528 | 4/1996 | Iwanaga | 123/467 |
| 5,626,119 | 5/1997 | Timms | 123/467 |
| 5,664,545 | 9/1997 | Kato | 123/467 |

FOREIGN PATENT DOCUMENTS

| | | |
|---|---|---|
| 0409264 | 1/1991 | European Pat. Off. . |
| 0459429 | 12/1991 | European Pat. Off. . |
| 0643 221 | 3/1995 | European Pat. Off. . |
| 3618447 | 12/1987 | Germany . |
| 2069047 | 8/1981 | United Kingdom . |
| 2185530 | 7/1987 | United Kingdom . |

OTHER PUBLICATIONS

European Search Report Application EP96106453.

*Primary Examiner*—Carl S. Miller
*Attorney, Agent, or Firm*—Rader, Fishman & Grauer PLLC

[57] ABSTRACT

A fuel injection system includes a fuel injector having a body, a needle valve movably provided in the body and a fuel accumulator having two chambers for storing a fuel at high and low pressures. An injection chamber is formed in the injector lower body and a control chamber is formed in the injector upper body. An injection passage connects the high pressure chamber with the injection chamber and a control passage connects the low pressure chamber with the control chamber. The needle valve is lifted upon leaking of the fuel to the accumulator from the control chamber and the fuel is injected from the injection chamber upon lifting of the needle valve. The fuel is recycled to the fuel tank from the control chamber.

8 Claims, 9 Drawing Sheets

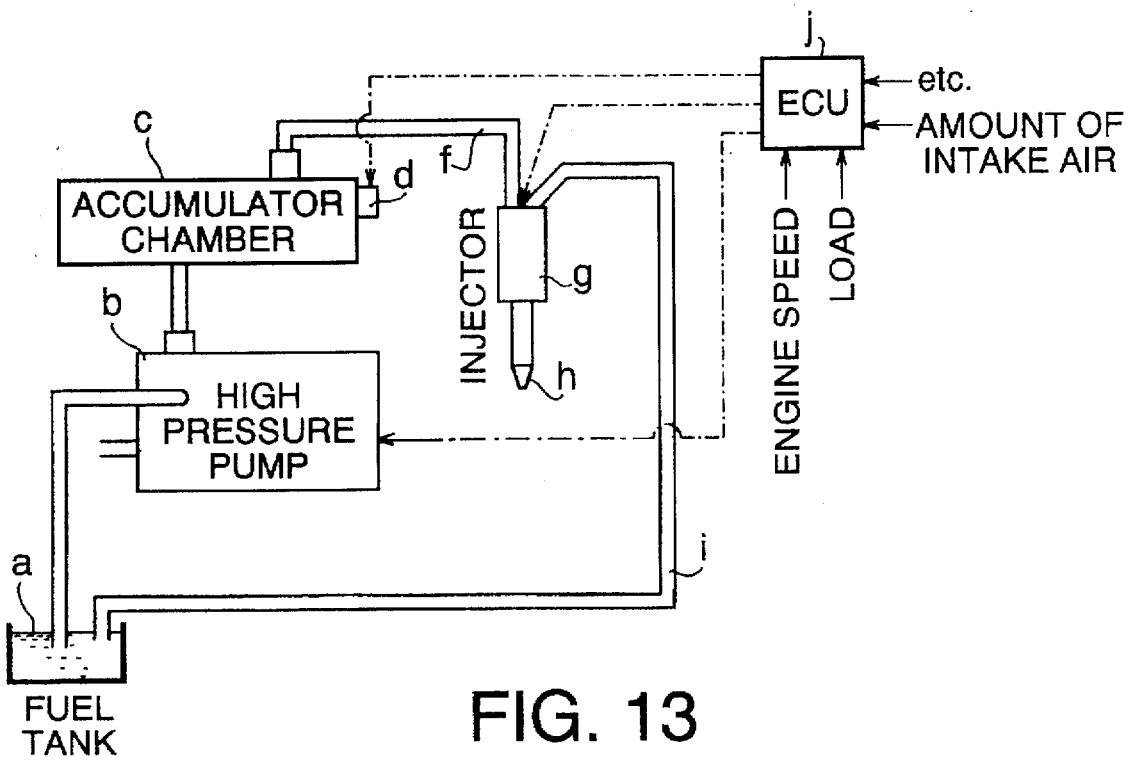
FIG. 13
*PRIOR ART*
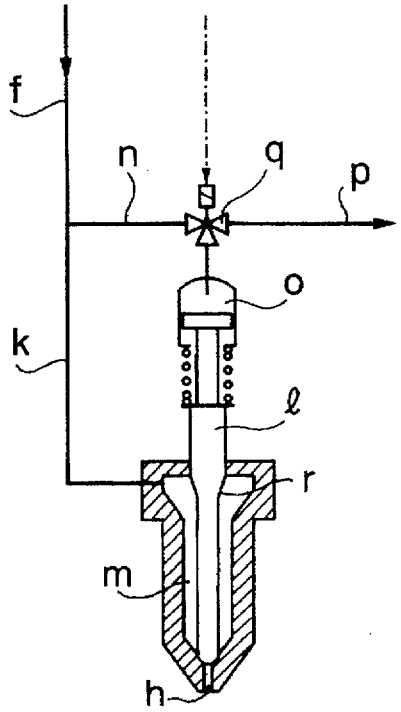
FIG. 14 *PRIOR ART*

ACCUMULATOR-TYPE FUEL INJECTION SYSTEM

BACKGROUND OF THE INVENTION

1. Technical Field

This invention relates to an accumulator-type fuel injection system for feeding a pressurized fuel to a fuel injector of a diesel engine from an accumulator chamber.

2. Background Art

Accumulator-type fuel injection systems are known in the art. One typical example of such systems is schematically illustrated in FIG. 13 of the accompanying drawings. Referring to FIG. 13, a fuel in a fuel tank "a" is pumped by a high pressure pump "b" and the pressurized fuel is transferred from the pump "b" to an accumulator chamber "c", which is generally referred to as a common rail, and stored therein under a pressurized condition. The pressure in the accumulator chamber "c" is detected by a pressure sensor "d" and fed back to an ECU (Engine Control Unit) "j" such that an amount of fuel supplied to the accumulator chamber "c" by the pump "b" is controlled to an appropriate value.

The high pressure fuel in the accumulator chamber "c" is introduced to an injector "g" through a feed line "f". Upon opening and closing of an electromagnetic valve "q" (i.e., three-way valve, which will be described later: FIG. 14) located in the injector "g", the pressurized fuel is injected into a combustion chamber of an engine (not shown) such as a diesel engine from an injection opening or injection hole "h" at an end of the injector. A recycle line "i" extends to the fuel tank "a" from the injector "g" to return an excessive fuel to the fuel tank "a" from the injector "g". The high pressure pump "b", accumulator chamber "c" and injector "g" are controlled by the control unit "j" respectively.

Referring to FIG. 14 of the accompanying drawings, illustrated is a schema of the injector "g". As depicted, the pressurized fuel stored in the accumulator chamber "c" in the fuel feed line "f" is partly fed to an injection chamber "m" through an injection line "k" branched from the fuel feed line "f" and the remainder is introduced to a control chamber "o" through a branch line "n". A front or lower end portion of a needle valve "1" is located in the injection chamber "m" and a rear or upper end portion of the needle valve "l" is located in the control chamber "o". The fuel in the control chamber "o" is directed to the recycle line "i" from a leak line "p". At connection of the leak line "p" and control line "n", provided is the three-way valve "q" (electromagnetic valve). The three-way valve "q" connects the control line "n" with the control chamber "o" in its feed state and connects the control chamber "o" with the leak line "p" in its leak state.

The fuel pressure in the injection chamber "m" acts on a cone portion "r" of the needle valve "l" to lift the needle valve (or open the needle valve) whereas the fuel pressure in the control chamber "o" acts on the tail of the needle valve to lower it (or close it). If the fuel pressure in the chamber "m" is balanced with that in the chamber "o" and the three-way valve "q" is switched to the leak state, the pressure balance is lost so that the needle valve "l" moves upward and the fuel in the injection chamber "m" is injected from the injection opening "h" formed at the nozzle tip. After that, by switching the three-way valve "q" to the feed state, the upper and lower pressures are balanced again so that the needle valve "l" moves downward and closes the opening "h" to complete the fuel injection.

The injection chamber "m" for holding the fuel to be injected and the control chamber "o" for lifting/lowering the needle valve are communicated with the accumulator chamber "c" by the fuel feed line "f" and its branches "k" and "n". Therefore, if the pressure in the accumulator chamber "c" is raised to obtain a higher fuel injection pressure (i.e., a higher pressure in the injection chamber "m"), it also results in a higher pressure in the control chamber "o". As a result, an amount of the fuel leaking to the leak line "p" from the control chamber "o" through the three-way valve "q" increases. This raises an wasted work of the pump "b" and deteriorates a fuel consumption rate of a vehicle.

In addition, if a high pressure is applied to the three-way valve "q", a lateral pressure is inherently generated because of the structure of the three-way valve. If the lateral pressure is generated, a larger drive power is required to maintain a desired operation. As a result, an electric power or current consumed by the three-way valve "q" increases.

Furthermore, if the pressure in the control chamber "o" is raised, scratching and/or deformations occur in the three-way valve "q". This shortens and deteriorates durability and liability of the three-way valve. Also, this hinders smooth movement of the three-way valve so that response characteristics of the valve are degraded.

The pressure in the injection room "m" varies with closing/opening of the needle valve "l". This pressure change is transferred to the three-way valve "q" via the passages "k" and "n" and might also damage the three-way valve "q".

Another known arrangement is disclosed in Japanese Patent Application, Publication No. 6-108948.

SUMMARY OF THE INVENTION

An object of this invention is to provide a fuel injection system for an engine not having drawbacks of a prior fuel injection system.

Another object of this invention is to provide a fuel injection system for an engine having an accumulator injection pump which can inject a high pressure fuel with less fuel leakage.

Still another object of the present invention is to provide a fuel injection system having two accumulators which will not be damaged even if operated under a super-high or ultra-high pressure.

According to one aspect of the present invention, there is provided a fuel injection system including: a fuel injector having a needle valve movably placed therein, an injection chamber formed in an injector body in its lower end portion, a control chamber formed in the injector body upper end portion; a fuel accumulator chamber having a high pressure chamber for storing a high pressure fuel and a low pressure chamber for storing a low pressure fuel; an injection passage for connecting the high pressure chamber with the injection chamber; a control passage for connecting the low pressure chamber with the control chamber; and means for selectively feeding the fuel to the control chamber and the injection chamber from the high and low pressure chambers of the fuel accumulator. The needle valve is lifted upon leaking of the fuel to the accumulator from the control chamber and the fuel is injected from the injection chamber upon lifting of the needle valve. The high pressure fuel is only fed to the injection chamber via the injection passage whereas the low pressure fuel is only fed to the control chamber via the control passage. Therefore, the high pressure fuel is sprayed from the injector upon lifting of the needle valve. The low pressure fuel is used to activate the needle valve and then allowed to leak or escape to a recovery line which extends to the fuel accumulator under low pressure. Since the leak fuel is a low pressure fuel and the injection fuel is a high pressure fuel, the object of the invention is achieved.

A bypass passage may be provided for connecting the injection passage with the control passage, a first open/close valve may be provided in the injection passage upstream of a bypass passage-injection passage connection and a second open/close valve may be provided in the leak passage. First, the first and second open/close valves are both closed. Then, the second valve is only opened to allow the fuel to leak from the control chamber to the leak passage. This causes the needle valve to be lifted. At this point, the low pressure fuel is only fed to the injection chamber through the bypass line. Therefore, the low pressure fuel is sprayed from the injector. After a while, the first open/close valve is also opened to introduce a high pressure fuel into the injection chamber. Then, this high pressure fuel is sprayed from the injector. The low pressure fuel injection is performed during an initial combustion period and the high pressure fuel injection is performed thereafter. The low pressure fuel injection results in a relatively slow or moderate combustion so that quick combustion temperature rise is prevented and in turn generation of NOx is reduced.

A throat portion may be formed in the injection passage between the first open/close valve and the bypass passage-injection passage connection. The high pressure fuel unavoidably advances through the throat portion so that an only limited amount of high pressure fuel is fed to the injection chamber. Therefore, the fuel pressure injected from the injector gently rises even after feeding of the high pressure fuel. This further contributes to reduction of NOx.

According to another aspect of the present invention, there is provided a fuel injection system including: a fuel injector having a body, a needle valve movably placed in the body, a control chamber formed in an upper portion of the injector body and an injection chamber formed in a lower portion of the injector body; a fuel tank for storing a fuel; means for feeding a high pressure fuel to the control chamber; means for allowing the fuel to leak from the control chamber to the fuel tank; a leakage line connected with the control chamber for returning the leaked fuel to the fuel tank, the needle valve being adapted to be moved downward as the high pressure fuel is supplied to the control chamber from the fuel tank and to be moved upward as the fuel leaks to the leakage line from the control chamber; valve means for throttling the leakage line to raise a pressure of the fuel in the leakage line; control means for actuating the valve means to maintain difference between the pressure of the fuel in the leakage line and a pressure of the high pressure fuel to a predetermined value. The pressure of the fuel in the leakage line has a raised value so that the pressure difference between the feed fuel and the leakage fuel is reduced. Accordingly, breakage due to a large pressure difference would not occur in the fuel injector.

The control means may include a first sensor for detecting the pressure of the high pressure fuel, a second sensor for detecting the pressure of the fuel in the leakage line, means for comparing these pressures to determine difference between these pressures and means for driving the valve means based on the pressure difference.

The leakage line may include a second accumulator chamber for storing the leaked fuel at a predetermined pressure and a valve provided at an exit of the second accumulator chamber to adjust an amount of fuel to be discharged from the accumulator chamber.

The valve may be a duty control solenoid valve.

The high pressure fuel feeding means may be a first accumulator chamber.

These and other objects and advantages of the fuel injection system of the present invention will become more apparent as the following detailed description and the appended claims are read and understood with the accompanying drawings.

BRIEF DESCRIPTION OF THE ACCOMPANYING DRAWINGS

Figure 4:
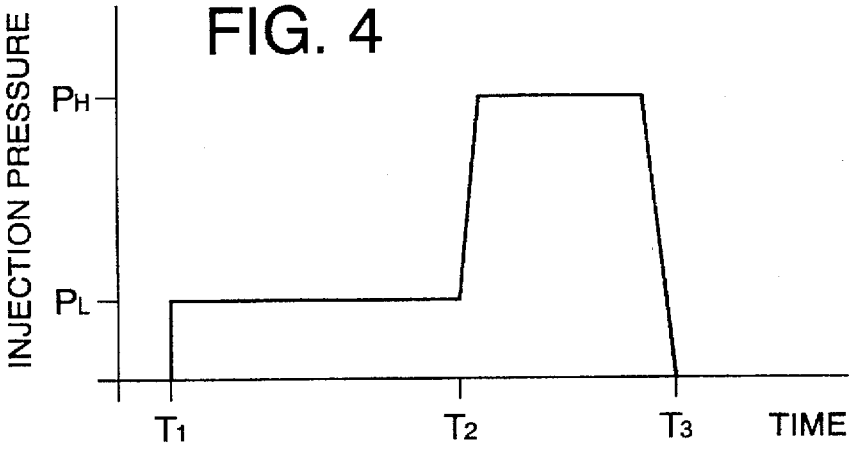
Figure 6:
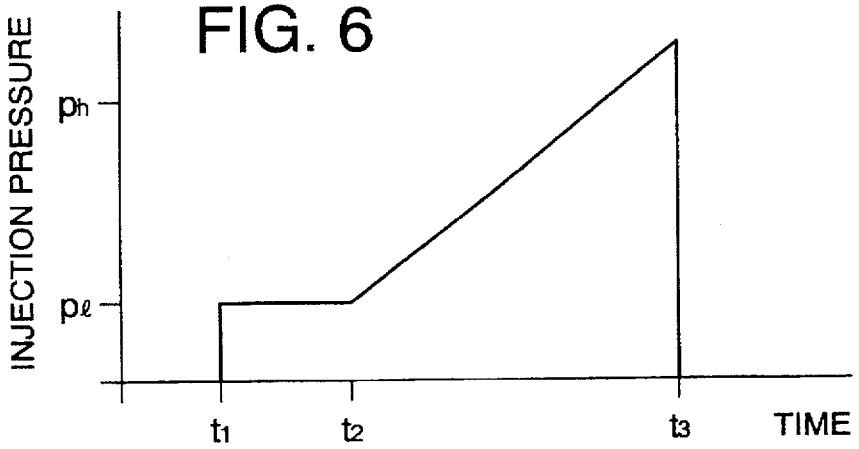
Figure 3:
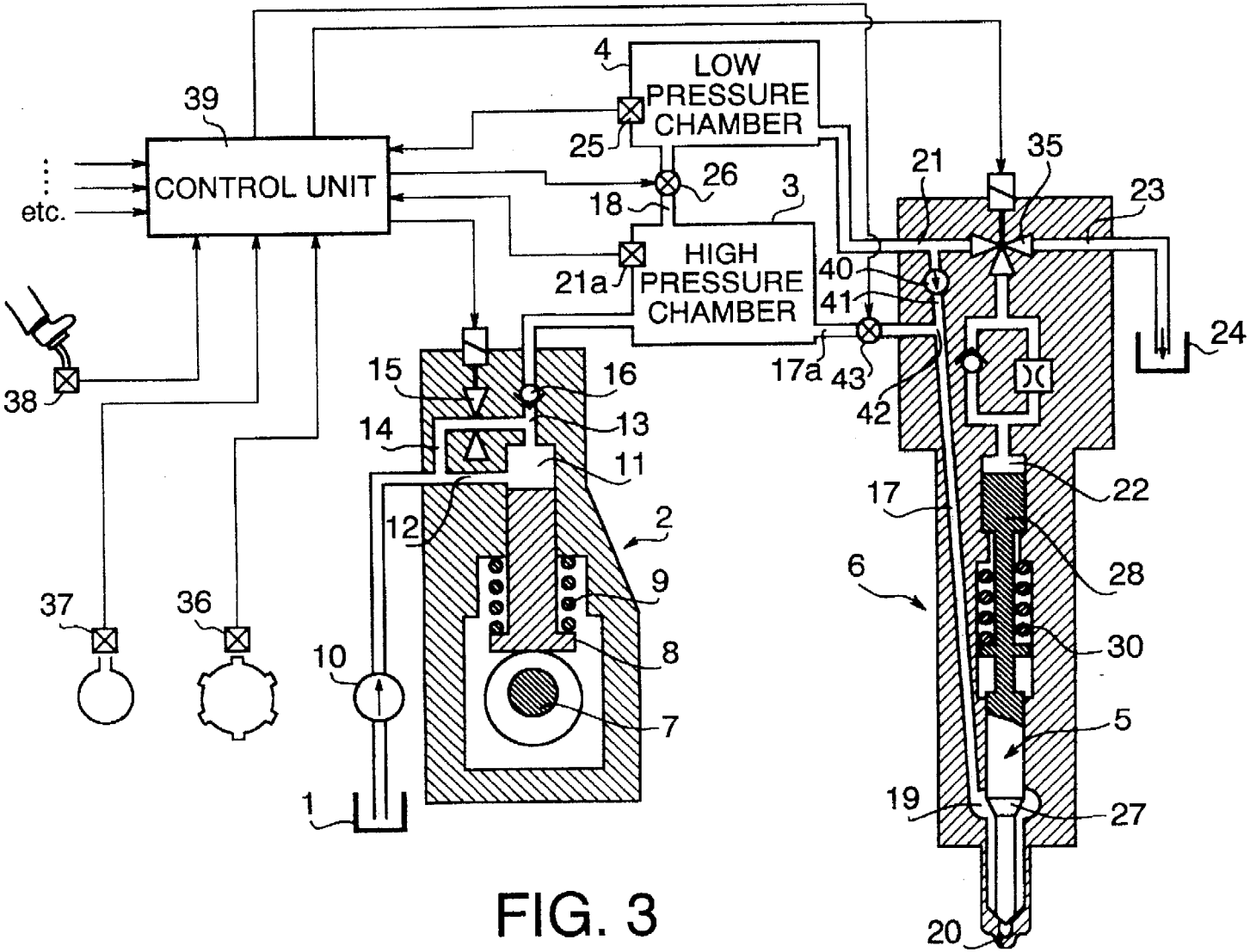
Figure 5:
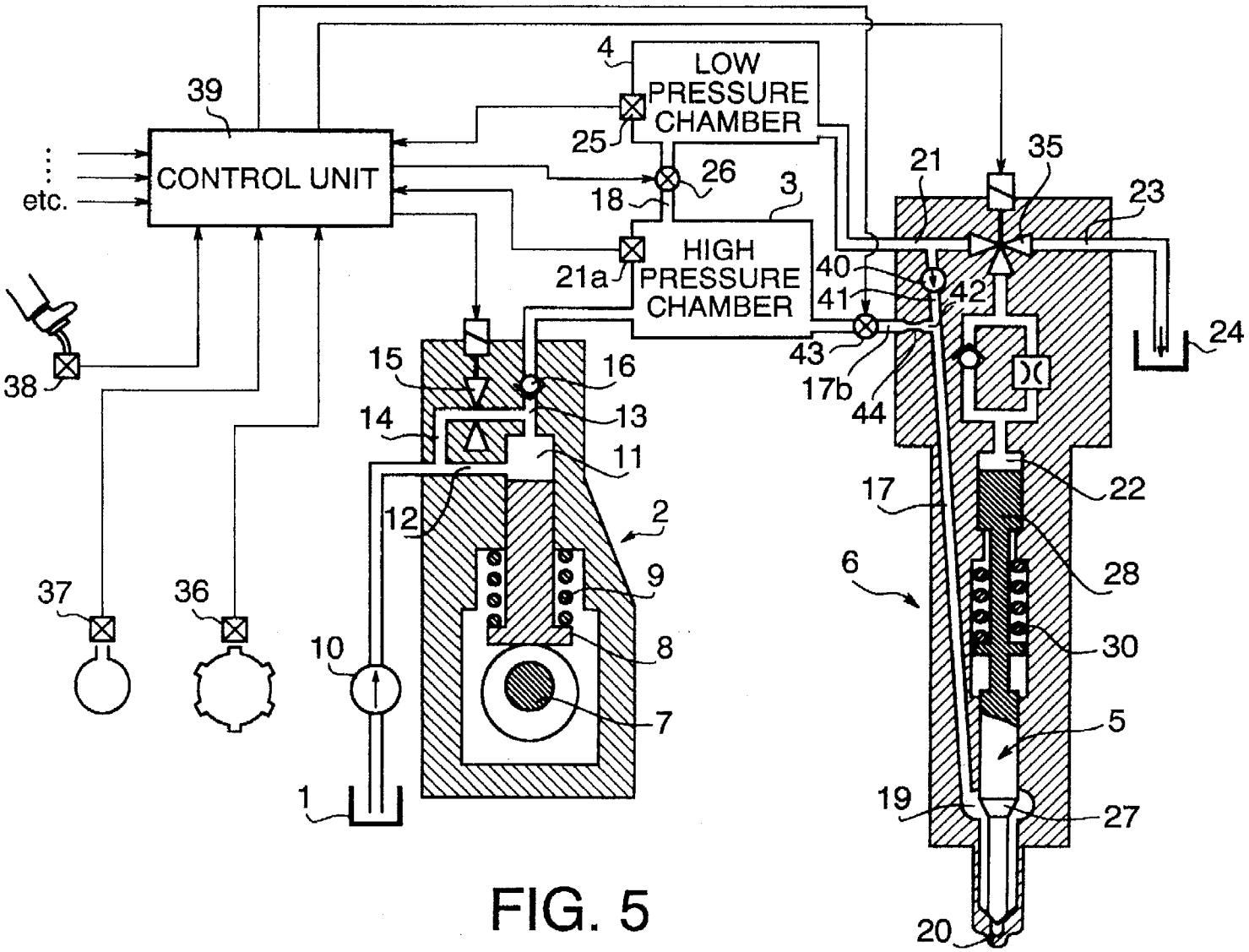
Figure 7:
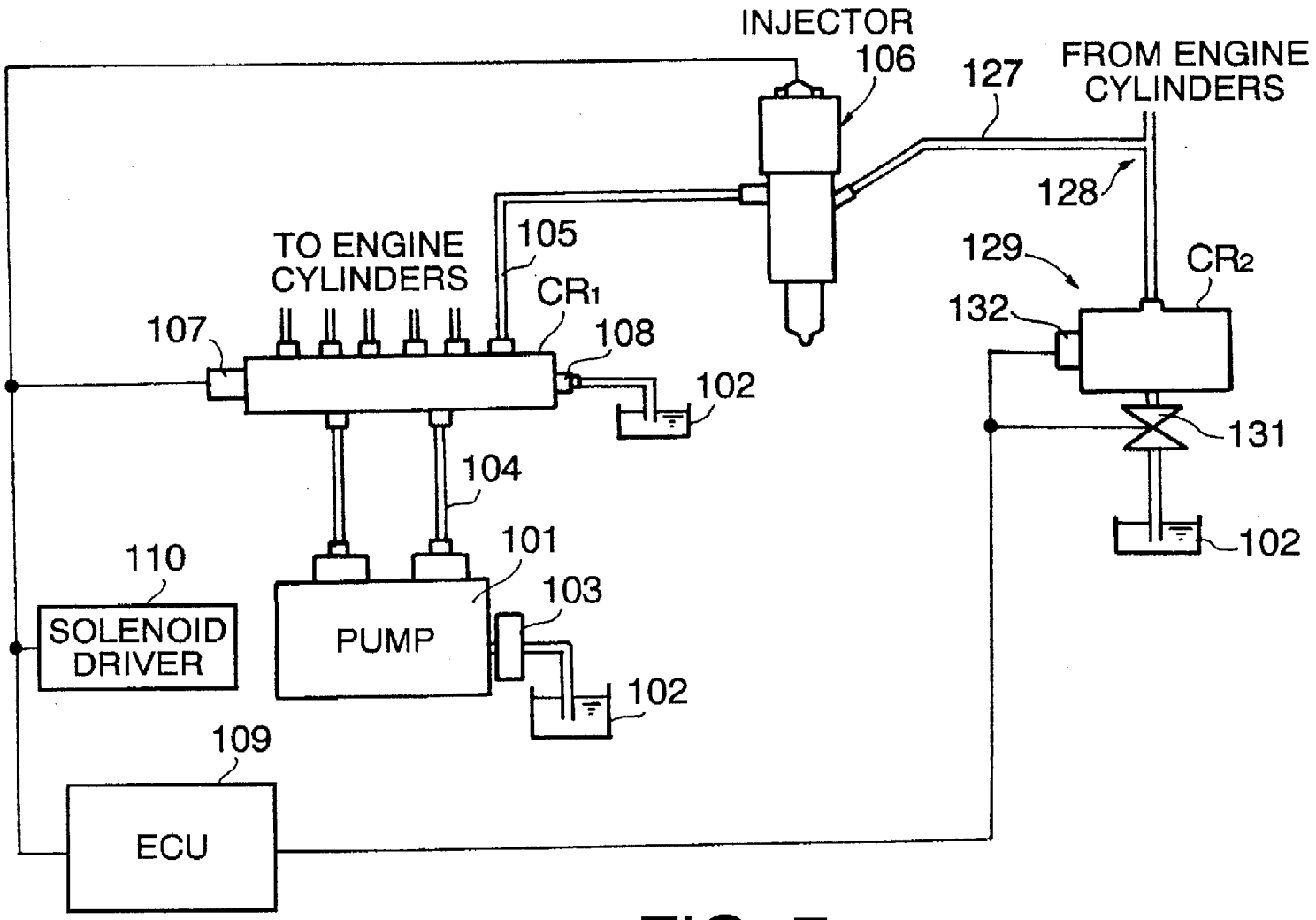
Figure 8:
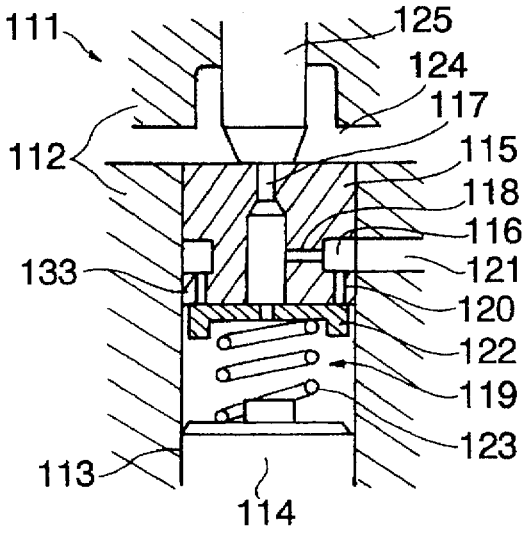
Figure 9:
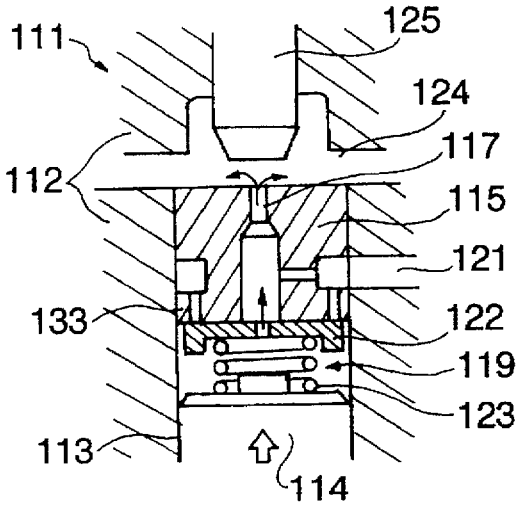
Figure 10:
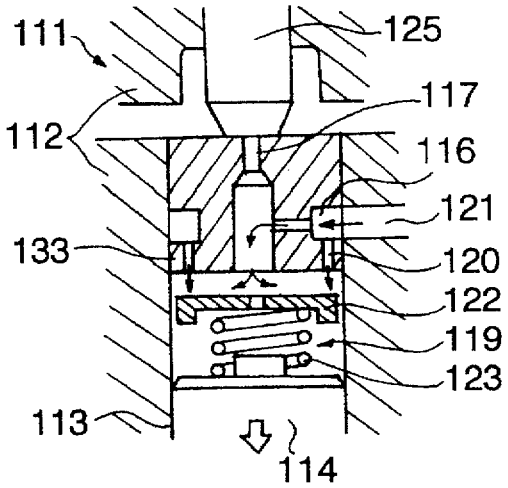
Figure 11:
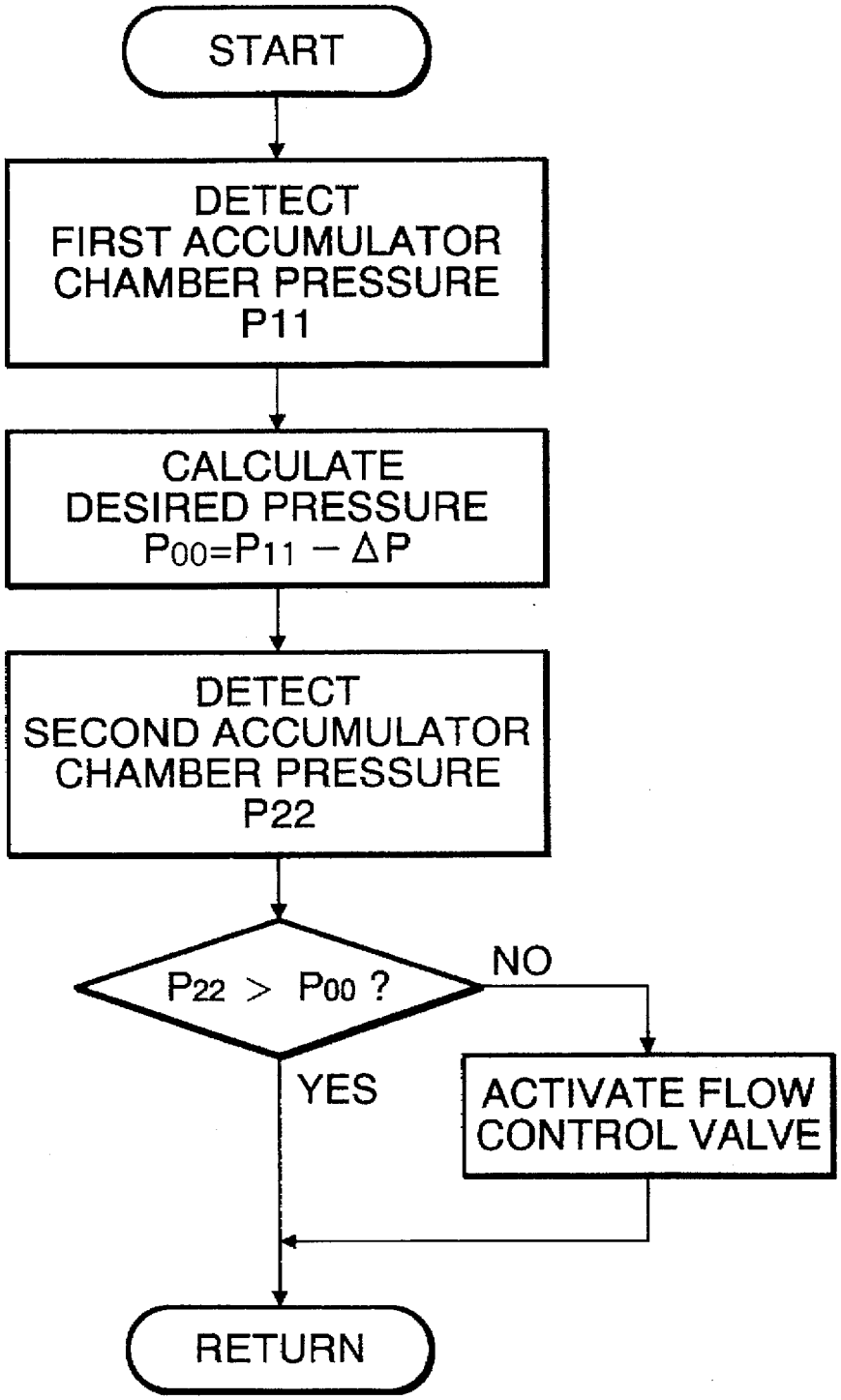
Figure 12A:
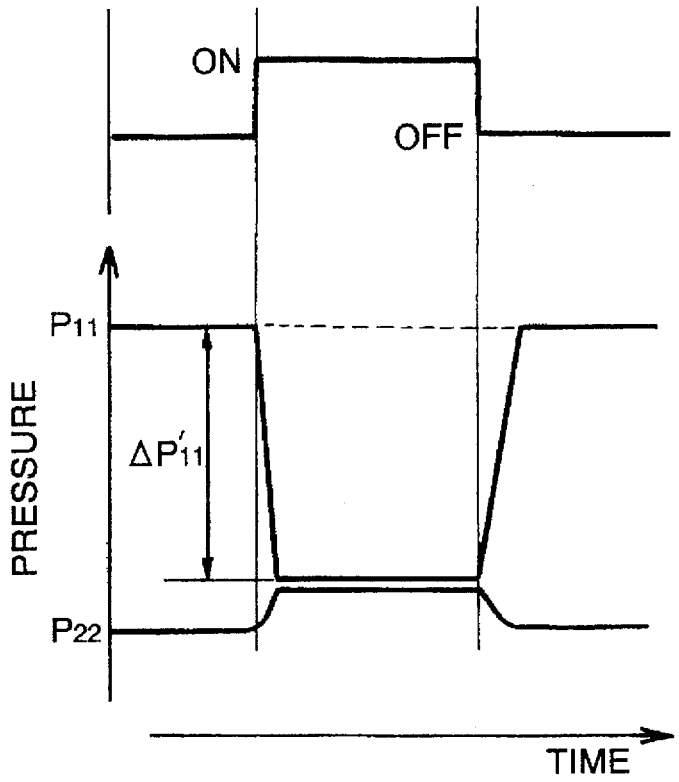
Figure 12B:
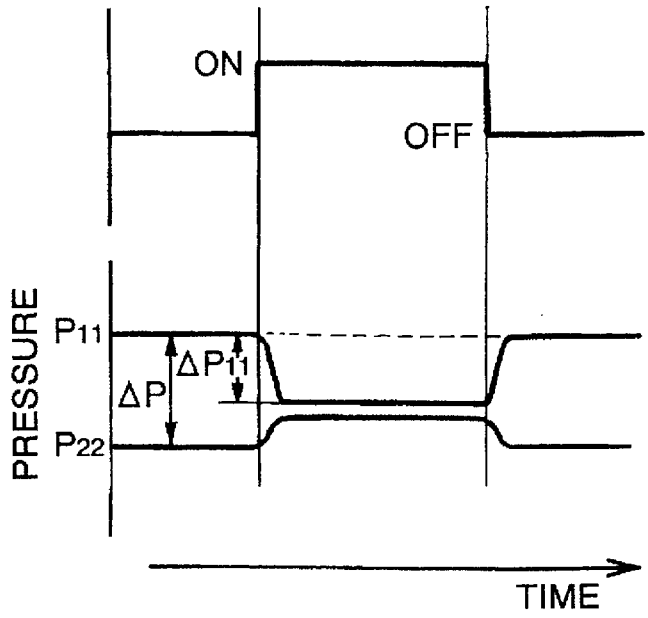

FIG. 3 schematically illustrates another fuel injection system (second embodiment) according to the present invention;

FIG. 4 illustrates injection characteristics of the fuel injection system shown in FIG. 3;

FIG. 5 depicts a schematic construction of a third embodiment system according to the present invention;

FIG. 6 illustrates injection characteristics of the fuel injection system shown in FIG. 5;

FIG. 7 illustrates a schematic diagram of another accumulator-type fuel injection system according to the present invention;

FIG. 8 is an enlarged fragmentary sectional view of a control chamber area of an injector of the fuel injection system shown in FIG. 7 when the injector is in a non-injection condition;

FIG. 9 is a view similar to FIG. 8, but in an injection condition;

FIG. 10 is a view similar to FIG. 8, but in an injection-just-completed condition;

FIG. 11 is a flowchart for an ECU shown in FIG. 7;

FIG. 12A is a diagram showing pressure change of a feed fuel and a leakage fuel of a prior art fuel injection system;

FIG. 12B is a diagram similar to FIG. 12A, but shows the pressure change of the fuel injection system of the present invention;

FIG. 13 shows a conventional fuel injection system; and

FIG. 14 shows another conventional fuel injection system.

DETAILED DESCRIPTION OF THE PREFERRED EMBODIMENTS

Preferred embodiments of the present invention will be described in reference to the accompanying drawings.

Figure 1:
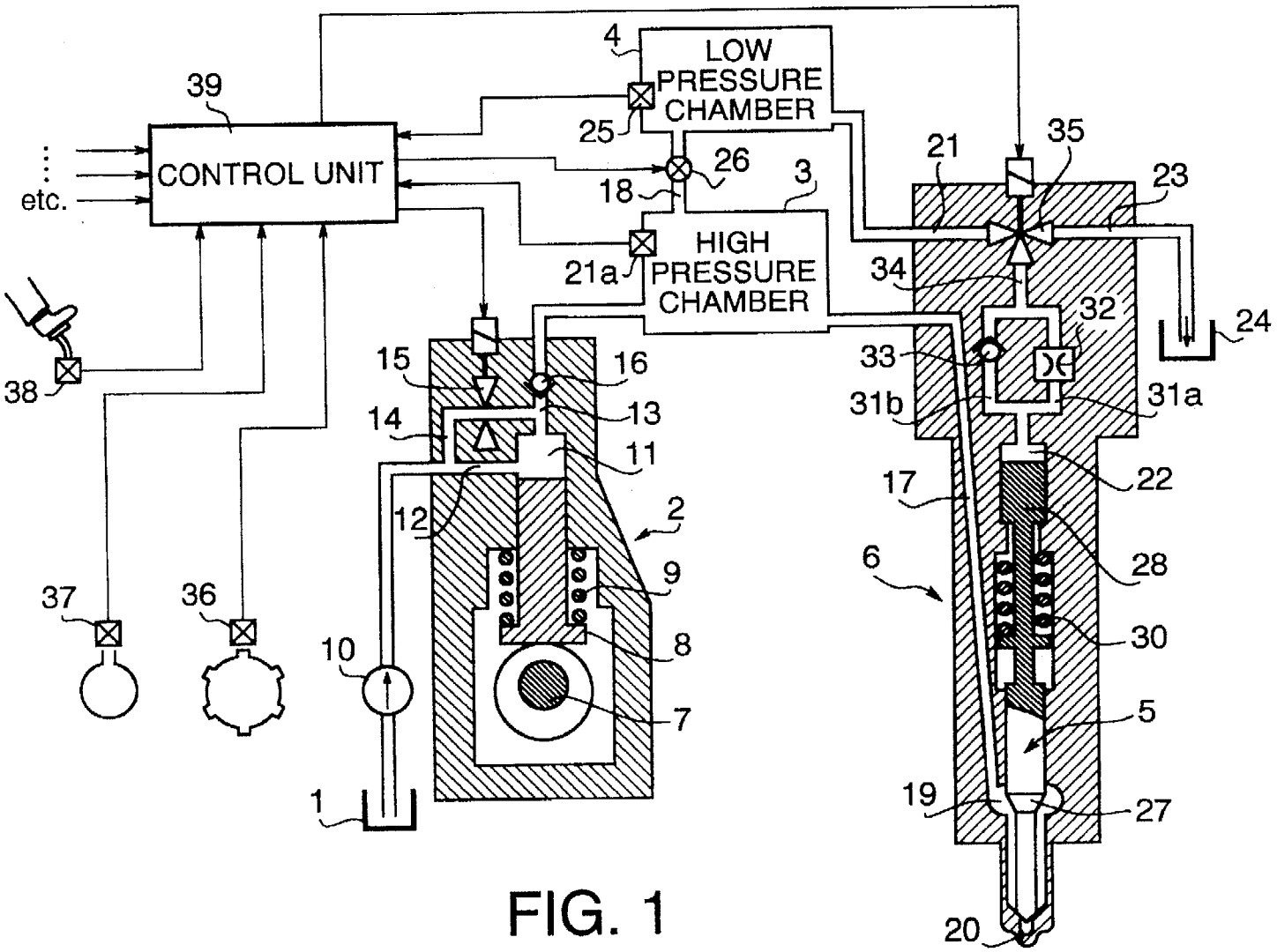
FIG. 1 illustrates a schematic view of an accumulator-type fuel injection system according to the present invention.

Referring to FIG. 1, an accumulator-type fuel injection system includes a high pressure pump 2 for pressurizing a fuel in a fuel tank 1 and delivering it to a predetermined destination, a high pressure chamber 3 connected with the high pressure pump 2 for storing the fuel under high pressure (e.g., about 1,200 bar), a low pressure chamber 4 connected with the high pressure chamber 3 for storing the fuel under low pressure (e.g., about 600 bar) and an injector 6 for utilizing the fuel from the high pressure chamber 3 as an injection fuel and the fuel from the low pressure chamber 4 as a working fluid for a needle valve 5.

In the high pressure pump 2, a plunger 8 moves reciprocally against a spring 9 upon rotation of a camshaft 7 connected with a crankshaft or a similar member of an engine so that the fuel pumped from the fuel tank 1 by a pump 10 is pressurized in a cylinder 11 and transferred it to the high pressure chamber 3. An entrance passage 12 is bypassed from a discharge passage 13 of the high pressure pump 2 by a return passage 14. An open/close valve 15 is provided in the return passage 14. A check valve 16 is provided in the discharge passage 13.

The high pressure chamber 3 holds the high pressure fuel transmitted from the high pressure pump via the discharge passage 13 at the pressure of approximately 1,200 bar. An injection passage 17 extends to the injector 6 from the high pressure chamber 3 and a communication passage 18 also extends to the low pressure chamber 4 from the high pressure chamber 3. Therefore, part of the fuel in the high pressure chamber 3 is introduced to the low pressure chamber 4 through the communication passage 18 and the remaining fuel is introduced through the injection passage 17 to an injection chamber 19 formed in the lower end portion of the injector 6 near the tip of the needle valve 5. The fuel in the injection chamber 19 is used as a fuel to be injected: it is injected from an injection opening 20 upon lifting of the needle valve 5. A pressure sensor 21*a* is provided in the high pressure chamber 3.

The low pressure chamber 4 stores the fuel transmitted from the high pressure chamber 3 via the communication passage 18 at a low pressure (approximately 600 bar). A control passage 21 extends to the injector 6 from the low pressure chamber 4. The fuel flows from the low pressure chamber 4 through the control passage 21 and enters a control chamber 22 formed in the injector 6 near the tail of the needle valve 5. This fuel is used to activate the needle valve (referred to as "working fluid") and ultimately discharged to a recovery unit 24 via a leak passage 23. A pressure sensor 25 is provided in the low pressure chamber 4 and an open/close valve 26 (e.g., electromagnetic valve) is provided in the communication passage 18.

The injector 6 uses the high pressure fuel from the high pressure chamber 3 as the injection fuel and uses the low pressure fuel from the low pressure chamber 4 as the working fluid. The needle valve 5 is housed in the injector 6 such that it can move reciprocally in the axial direction of the needle valve or the longitudinal direction of the injector 6. The injection chamber 19 is formed on the lower or front end side of the needle valve 5 and the control chamber 22 is formed on the upper or rear end side. Specifically, the injection chamber 19 surrounds a cone portion 27 of the needle valve 5 and the control chamber 22 is defined by a cylinder 29 formed to guide a piston portion 28 of the needle valve 5. The needle valve 5 is normally biased downward by a coil spring 30 to close the injection opening 20.

A fork way 31*a*/31*b* extends from the control chamber 22. An orifice 32 is formed in one route 31*a* and a check valve 33 is provided in the other route 31*b*. These two routes 31*a* and 31*b* meet to form a single route 34. This route 34 is selectively connected with the leak passage 23 or the control passage 21 by a three-way valve 35 (electromagnetic valve). The three-way valve 35 can take a feed condition to communicate the control passage 21 with the passage 34 (and in turn the control chamber 22) and a leak condition to communicate the leak passage 23 with the passage 34 (and in turn the control chamber 22). The leak passage 23 allows the fuel in the control chamber 22 to escape to the recovery unit 24 from the control chamber 22.

The needle valve 5 of the injector 6 is forced upwardly by a pressure of the fuel in the injection chamber 19 and at the same time forced downwardly by a fuel pressure in the control chamber 22 and a coil spring 30. The needle valve 5 is maintained at a closed position upon balancing of the two opposite force. If the three-way valve 35 is switched to the leak condition, then the balanced situation is lost and the needle valve 5 moves upward so that the fuel in the injection chamber 19 is sprayed from the injection opening 20 at the tip of the nozzle. After that, if the three-way valve 35 is switched to the feed condition, then the needle valve 5 is moved downward to close the injection opening 20 upon balancing of the upward and downward forces.

The pressure sensor 21*a* of the high pressure chamber 3, the pressure sensor 25 of the low pressure chamber 25, a sensor 36 for an engine speed and a cam angle, a sensor 37 for determination of cylinder into which the fuel be injected, a sensor 38 for an engine load and other sensors for various engine and driving information such as amount of intake air are all coupled to a control unit 39 (ECU). The control unit 39 controls the three-way valve 35, the valve 26 of the passage 18 and the valve 15 of the high pressure pump 2 based on information fed from these sensors.

Specifically, the control unit 39 controls the valve 15 of the high pressure pump 2 in accordance with data detected by the pressure sensor 21*a* of the high pressure chamber 3 such that part of the fuel pressurized by the plunger 8 is caused to return to the inlet passage 12 through the return passage 14 so as to maintain the fuel pressure in the high pressure chamber 3 at a substantially constant value (about 1,200 bar). The control unit 39 also keeps the fuel pressure in the low pressure chamber 4 at a substantially constant value (about 600 bar) in the following manner.

Figure 2:
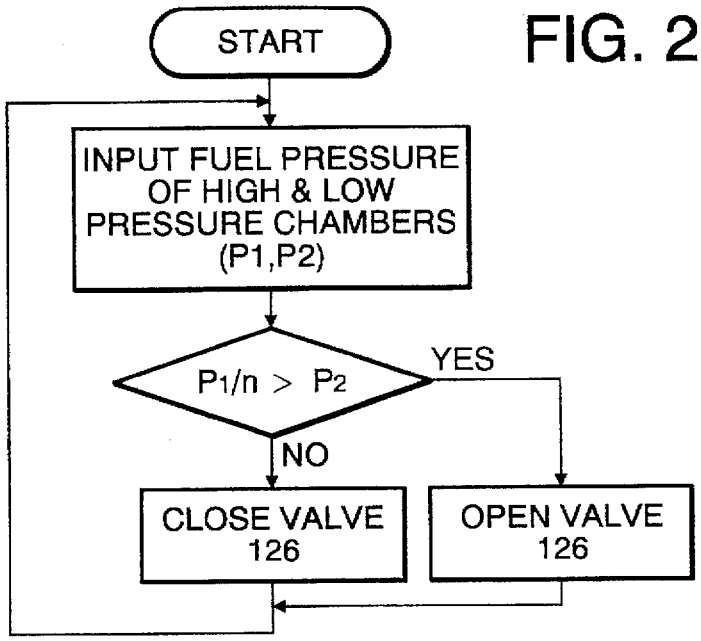
FIG. 2 is a flowchart of operations of an open/close valve provided between a high pressure chamber and a low pressure chamber shown in FIG. 1.

Referring to FIG. 2, first, the pressure P1 of the high pressure chamber 3 and the pressure P2 of the low pressure chamber 4 are detected by the associated pressure sensors 21*a* and 25 respectively to determine whether P1/n is greater than P2. Here, n is a ratio of the pressure in the high pressure chamber 3 to that in the low pressure chamber 4 and it is generally set to 2 to 4. If P1/n is greater than P2, the valve 26 on the communication line 18 is opened whereas if it is not, the valve 26 is closed. Such control can maintain the pressure ratio "n" to a certain value.

As understood from the flowchart shown in FIG. 2, keeping the fuel pressure in the high pressure chamber 3 to a particular value (e.g., about 1,200 bar) by opening and closing of the valve 15 of the high pressure pump 2 results in keeping the fuel pressure in the low pressure chamber 4 to one-"n"th the fuel pressure of the high pressure chamber 3. In this particular embodiment, "n"=2. Accordingly, the pressure in the low pressure chamber 4 is maintained to about 600 bar.

The control unit 39 determines the condition of the three-way valve 35 of the injector 6, the feed condition or the leak condition, according to data acquired from the engine speed and cam angle sensor 36 and other sensors. Upon switching to the leak condition, the needle valve 5 is lifted and the fuel in the fuel chamber 19 is sprayed from the injection opening 20 formed at the tip of the nozzle, whereas upon switching to the feed condition, the needle valve 5 is lowered to close the injection hole 20, as mentioned earlier.

Now, operations of the system will be described.

The fuel in the high pressure chamber 3 of about 1,200 bar is introduced to the injection chamber 19 through the injection passage 17 and injected upon lifting of the needle valve 5. On the other hand, the fuel in the low pressure chamber 4 of about 600 bar is supplied to the control chamber 22 through the control passage 21 as the three-way valve 35 is switched to the feed condition. Then, the low pressure fuel is used to activate the needle valve 5 and allowed to leak into the leak passage 23 under low pressure as the three-way valve 35 is switched to the leak condition.

Since the high pressure fuel of the high pressure chamber 3 is utilized as the injection fuel and the low pressure fuel of the low pressure chamber 4 is utilized as the working fluid for the needle valve 5, the fuel injection pressure is raised and the leakage fuel pressure is decreased. In other words, high pressure injection is achieved while achieving leakage fuel reduction. In this manner, the amount of leaking fuel is suppressed even if the injection pressure is raised. This reduces dead work of the high pressure pump 2 so that the fuel consumption rate is improved. The consumption current of the three-way valve 35 (electromagnetic valve) also drops.

Since the low pressure fuel is fed into the three-way valve 35 as the working fluid, scratching in the three-way valve 35 and/or deformations do not occur. This extends the durability of the three-way valve 35 and improves the reliability. Also, this ensures smooth movement/operation of the three-way valve 35 so that the response characteristic of the three-way valve 35 is maintained even if the injection pressure is raised.

The pressure in the injection chamber 19 varies with opening/closing of the needle valve 5, but this pressure change is moderated by the injection passage 17, high pressure chamber 3 and low pressure chamber 4 before it is transmitted to the three-way valve 35 via the control passage 21. Therefore, the three-way valve 35 is not damaged by the pressure fluctuation. In this manner, the pressure in the control passage 21 is maintained to a constant value regardless the opening/closing of the needle valve 5. Accordingly, precise control of the three-way valve 35 is possible in both feed and leak conditions.

Another embodiment according to the present invention will be described with reference to FIG. 3. The fundamental construction of the system of this embodiment is the same as that shown in FIG. 1 so that the same reference numerals are used and detailed description of these elements is omitted. Hereunder, only differences as compared with the previous embodiment will be described.

Referring to FIG. 3, the injection passage 17 of the injector 6 is communicated with the control passage 21 by a bypass passage 41 having a one-way valve 40. A first open/close valve 43 is provided in the injection passage **17*a* upstream of a bypass passage-injection passage connection 42. The three-way valve 35 serves as a second open/close valve since it allows the fuel in the control chamber 22 to escape to the recovery unit 24 through the leak passage 23** when it is in the leak condition.

Operations of this embodiment will now be described.

In FIG. 3, first, the first open/close valve 43 in the injection passage **17*a* is closed and the three-way valve 35 is set to the feed condition. Then, the three-way valve 35 is changed to the leak condition. This causes the fuel in the control chamber 22 to proceed to the recovery unit 24 through the leak passage 23 and in turn causes the needle valve 5 to lift thereby injecting the fuel from the injection chamber 19. At this point, the low pressure fuel of the low pressure chamber 4 has been supplied to the injection chamber 19 via the control passage 21, the bypass passage 41 and the injection passage 17**. Therefore, the fuel injection nozzle performs low pressure injection.

After that, as the first open/close valve 43 is opened, the high pressure fuel of the high pressure chamber 3 is supplied to the injection chamber 19 through the injection passages **17*a* and 17. Thus, the fuel injection nozzle now performs high pressure injection. Such changes in the injection pressure are illustrated in FIG. 4. As seen in this illustration, the three-way valve 35 is set to the leak state at the time T1 to conduct the low pressure injection ($P_L$), the first open/close valve 43 is opened at the time of T2 to conduct the high pressure injection ($P_H$), and the first open/close valve 43 is closed and the three-way valve 35 is switched to the feed state at the time of T3** to complete the fuel injection. This operation provides a two-stage fuel injection.

This stepwise fuel injection suppresses preliminary combustion or initial-stage combustion since less fuel is fed during the low pressure injection. Accordingly, quick rise of combustion chamber temperature is prevented and generation of NOx is reduced particularly during the initial stage of combustion.

Still another embodiment of the present invention will be described with reference to FIG. 5.

The basic structure of this system is also the same as the preceding embodiment so that the same reference numerals are assigned and detailed description of these parts will be omitted. Only difference lies in that provision of a throttling portion 44 in the injection passage **17*b* between the first open/close valve 43 and the injection passage-bypass passage connection 42**.

When the first open/close valve 43 is opened for high pressure fuel injection, the fuel in the injection passage **17*b* is throttled by the throat portion 44 so that increase in the fuel pressure becomes gentle. This is illustrated in FIG. 6. As understood from this diagram, the three-way valve 35 is set to the leak state at the time of t1 for the low pressure injection ($p_l$), the first open/close valve 43 is opened at the time of t2 for gentle transition to the high pressure injection ($p_h$), and the first open/close valve 43 is closed and the three-way valve 35 is changed to the feed state at the time of t3** for completion of the fuel injection.

The high pressure injection is performed in a non-sharp manner as indicated by the relatively gentle slope between t2 and t3 in FIG. 6, so that the combustion temperature does not rise suddenly during the initial combustion period and generation of NOx is further suppressed.

A fourth embodiment of the present invention will be described according to FIGS. 7 to 12B.

Referring first to FIG. 7, a pump 101 draws a fuel of atmospheric pressure from a fuel tank 102 via a fuel filter 103, pressurizes it and feeds it to a first accumulator chamber (common rail) CR1 through pipes 104. From the first accumulator chamber CR1, the high pressure fuel is always fed to injectors 106 through pipes 105. One injector 106 is provided for each cylinder of an engine. (Only one injector is illustrated.) The injector 106 is adapted to inject the high pressure fuel from its injection opening. A common rail pressure sensor 107 and a pressure limiter 108 are provided in the first accumulator chamber CR1. These sensors are electrically coupled to an ECU 109 which incorporates a computer. The ECU 109 activates the pressure limiter 108 in accordance with data detected by the common rail pressure sensor 107 such that the fuel is forced to return to the fuel tank 102 in order to maintain the inner pressure of the first common rail CR1 in a prescribed range. The injector 106 is electrically connected with the ECU 109 and a solenoid driver 110. The ECU 109 sends on and off signals to the solenoid driver 110 according to a predetermined injection timing: the solenoid driver 110 applies an electric power to a solenoid valve (not shown) in the injector 106 upon receiving the on signal from the ECU 109 and stops application of electric power upon receiving the off signal. As the solenoid valve is turned on, the injector 106 starts the fuel injection. At this point, the high pressure fuel is caused to leak from the control chamber of the injector 106.

FIGS. 8 to 10 depict construction of the control chamber area 111 of the injector 106: FIG. 8 illustrates a before-injection condition, FIG. 9 illustrates an injection condition and FIG. 10 illustrates a post-injection condition immediately after completion of the injection process. As illustrated, fuel passages and center bore 113 are formed in an injector body 112. A command piston 114 is slidably fitted in the center bore 113. The command piston 114 is axially aligned with the needle valve (not shown) which is provided below the command piston 114. The needle valve is moved up and down as the command piston 114 is moved up and down. In other words, the needle valve closes the nozzle hole for stoppage of fuel injection upon downward movement of the command piston 114 and it opens the nozzle hole for fuel injection upon upward movement of the command piston 114.

An orifice member 115 is fixedly placed in the center bore 113 at its upper end portion by, for example, press-fitting the orifice member 115 in the center bore 113. The orifice member 115 has an annular groove 116 formed in its outer periphery and an orifice hole 117 extending along its longitudinal center. The orifice hole 117 is enlarged in diameter approximately in its lower three quarters. The annular groove 116 is communicated with the orifice bore 117 by a connection passage 118. The annular groove 116 is also communicated with the control chamber 119 defined below the orifice member 115 by another connection passage 120. A high pressure fuel supply port 121 extends to the groove 116. A basin- or cap-like member 122 is movably provided in the control chamber 119, and a spring 123 is provided between the cap member 122 and the command piston 114 to apply opposite forces to the member 122 and the piston 114. The high pressure fuel is always fed to the feed port 121 from the feed pipe 105.

A leak passage 124 is defined above the orifice member 115 so that the leakage fuel can escape therethrough. The upper end of the orifice 117 opens to the leak passage 124 (i.e., the orifice 117 terminates at the leak passage 124.) The upper end of the orifice 117 is opened/closed by a rod member 125 moved up and down by a solenoid valve (not shown).

In the no-injection state shown in FIG. 8, the control chamber 119 is filled with a high pressure fuel so that the command piston 114 is pressed downward. Upon switching to the injection state shown in FIG. 9, the rod member 125 moves up so that the orifice bore 117 is opened. Then, the high pressure fuel in the control chamber 119 leaks to the leak passage 124 through the center hole of the cap member 122 and the orifice bore 117. As a result, the fuel pressure in the control chamber 119 becomes lower and the command piston 114 moves up against the force of the spring 123. Meantime, an upward force is always applied to the needle valve by the high pressure fuel. This force causes the piston 114 to move upward. To complete the fuel injection, the member 125 moves down and closes the orifice opening 117 as illustrated in FIG. 10. This raises the pressure in the orifice bore 117 so that the cap member 122 moves downward slightly. Then, the passage 120 connecting the groove 116 with the control chamber 119 is opened so that the high pressure fuel in the groove 116 enters the control chamber 119 through the orifice bore 117 and the passage 120 while further pushing the cap member 122 downwardly. This high pressure fuel reaches the command piston 114 through a annular gap between the cap member 122 and the cylinder 113 and through the center opening of the cap member 122 so that the command piston 114 is forced downward. Eventually, the pressure above the cap member 122 and that below the cap member 122 are balanced. Then, the spring 123 forces the cap member 122 upward and the cap member 122 contacts the orifice member 115 as illustrated in FIG. 8.

Referring back to FIG. 7, a leak pipe 127 extends from the injector 106. The leak pipe 127 is communicated with the leak passage 124 (FIG. 8). (One leak pipe extends from one injector 106 and the engine has a plurality of injectors. However, only injector 106 is depicted.) A plurality of leak pipes 127 is collected at a joint portion 128 and a single pipe extends from the joint 128 to a control device 129 for controlling a leak fuel pressure. The leak fuel pressure controller 129 includes a second accumulator chamber CR2 connected with the above-mentioned single pipe for storing the leak fuel at a certain pressure and a flow control valve 131 connected with the second accumulator chamber CR2 for adjusting an amount of fuel to be discharged from the second accumulator chamber CR2. The flow control valve 131 is provided downstream of the second accumulator chamber CR2 and throttles the exit of the second accumulator chamber CR2. After passing through the flow control valve 131, the fuel returns to the fuel tank 102. A duty control solenoid valve may be employed as the flow control valve 131 since its degree of opening (or throttling) is adjustable non-stepwise.

The second accumulator chamber CR2 is provided with a leak fuel pressure sensor 132 for detecting the leak fuel pressure or an inner pressure of the second accumulator chamber CR2. The leak pressure sensor 132 and the flow control valve 131 are electrically coupled with the ECU 109. In particular, the ECU 109 compares data detected by the leak pressure sensor 132 attached to the second accumulator chamber CR2 with data detected by the common rail pressure sensor 107 attached to the first accumulator chamber CR1 and causes the flow control valve 131 to open/close based on comparison result using a predetermined control program.

Conventionally, the pressure of the leakage fuel from the injector 106 is generally reduced to that of the fuel tank 102 (i.e., atmospheric pressure). In the present invention, however, it is feasible to raise the leakage fuel pressure above the atmospheric pressure.

Specifically, by controlling the degree of opening of the flow control valve 131 by the ECU 109, an amount of fuel discharged from the second accumulator chamber CR2 is limited and its pressure is maintained at a relatively high value. According if, the fuel pressure in the leak pipe 127 and that in the passage 124 of the injector 106 are also maintained at a relatively high value. Referring to FIG. 8 to 10, particularly the orifice member 115 has a plurality of passages for the low pressure fuel (i.e., the leakage fuel) and high pressure fuel formed therein. It should be noted here that the orifice member 115 is a relatively small element and the passages formed therein are close to each other. As a result, walls between the passages are subjected to a force exerted by fuel pressure difference. In the leak state shown in FIG. 9, for example, a downwardly directed bending force tends to be applied to an annular portion 133 below the groove 116. This annular portion 133 may be broken if a fuel of ultrahigh pressure is fed to the injector 106. In this embodiment, however, the pressure of the leakage fuel is raised so that the pressure difference between the low pressure fuel and the high pressure fuel is reduced. Therefore, breakage of the injector 106 is prevented and an ultrahigh pressure injection is possible.

Referring to FIG. 11, illustrated is a control flowchart for the ECU 109. First, the ECU 109 determines the pressure P11 of the first accumulator chamber CR1 using the detection value of the common rail pressure sensor 107. Then, in order to determine a desirable pressure P00 of the second accumulator chamber CR2, a predetermined pressure difference ΔP (e.g., 40 MPa) is subtracted from the detection value P11 of the common rail sensor 107. After that, the ECU 109 determines the pressure P22 of the second accumulator chamber CR2 from the detection value of the leak fuel pressure sensor 132. Then, the second accumulator chamber pressure P22 is compared with the desired pressure P00. If these two pressures have the same value, then the program returns to the first step (detection of the first accumulator chamber pressure P11). If the pressures do not coincide with each other, the ECU 109 activates the flow control valve 131 until they become equal to each other. Accordingly, the leak fuel pressure P22 always has a certain pressure difference ΔP as compared with the feed fuel pressure P11.

FIGS. 12A and 12B illustrate how the feed fuel pressure and leak fuel pressure change as the injector undergoes the non-injection condition and the injection condition. FIG. 12A depicts results of experiment conducted on a prior art fuel injection system and FIG. 12B depicts that conducted on the fuel injection system according to the invention. An upper diagram in each drawing shows on and off signals for the solenoid valve transmitted from the ECU 109 and a lower diagram shows the pressure change. The horizontal axis indicates time.

As seen in FIG. 12A, the leak fuel pressure P22' is considerably lower than the feed fuel pressure P11 at the non-injection condition. Thus, the feed fuel pressure P11 should drop considerably (ΔP11'). In the case of FIG. 12B, on the other hand, the leakage fuel pressure P22 has a raised value at the non-injection state so that the drop of the feed fuel pressure P11 is small as indicated by ΔP11. In FIG. 12B, ΔP which is the pressure difference between the feed fuel P11 and the leakage fuel P22 at the non-injection condition indicates the above-mentioned predetermined or desirable pressure difference of 40 MPa. This pressure difference ΔP is the minimum pressure difference to cause up and down movement of the needle valve in the injector 106. If this pressure difference is small, the needle valve response is generally degraded to a certain extent. However, it would be compensated by changing the diameter of the orifice bore 117 and/or the cap member's center opening. If no undesired phenomena occur, the small pressure difference only contributes to reduction of NOx since the smaller the pressure difference, the slower the proceeding of the initial stage of combustion of the engine.

What is claimed is:

1. A fuel injection system comprising:

a fuel injector having a body, a needle valve movably provided in the body, an injection chamber formed in the body in its lower end portion and a control chamber formed in the body in its upper end portion;

fuel accumulator means for storing a fuel, the fuel accumulator means having a high pressure chamber and a low pressure chamber;

an injection passage for connecting the high pressure chamber with the injection chamber;

a control passage for connecting the low pressure chamber with the control chamber;

means for selectively feeding the fuel to the control chamber and the injection chamber from the fuel accumulator means; and a leak passage for recycling the fuel to the fuel accumulator means from the control chamber, the needle valve being lifted upon leaking of the fuel to the accumulator means from the control chamber, the fuel being injected from the injection chamber upon lifting of the needle valve.

2. The fuel injection system of claim 1, further including:

a bypass passage for connecting the injection passage with the control passage;

a first open/close valve provided in the injection passage upstream of a bypass passage-injection passage connection; and a second open/close valve provided in the leak passage.

3. The fuel injection system of claim 2, further including a throat portion formed in the injection passage between the first open/close valve and the bypass passage-injection passage connection.

4. The fuel injection system of claim 1, wherein the high pressure chamber maintains the fuel at about 1,200 bar and the low pressure chamber maintains the fuel at about 600 bar.

5. The fuel injection system of claim 1, wherein the selectively feeding means includes a three-way valve provided in the control passage, and the control passage is communicated with the control chamber upon switching the three-way valve to a first condition whereas it is disconnected from the control chamber upon switching the three-way valve to a second condition.

6. A fuel injection system comprising:

a fuel injector having a body, a needle valve movably placed in the body, a control chamber formed in an upper portion of the body and an injection chamber formed in a lower portion of the body;

a fuel accumulator for storing a fuel;

means for feeding a high pressure fuel to the control chamber from the fuel accumulator;

means for allowing the fuel to leak from the control chamber;

a leakage line connected with the control chamber for returning the leaked fuel to the fuel accumulator, the needle valve being adapted to be moved downward as the high pressure fuel is supplied to the control chamber from the fuel accumulator and to be moved upward as the fuel leaks to the leakage line from the control chamber;

valve means for throttling the leakage line to raise a pressure of the fuel in the leakage line; and control means for actuating the valve means to maintain difference between the pressure of the fuel in the leakage line and a pressure of the high pressure fuel to a predetermined value.

7. The fuel injection system of claim 6, wherein the leakage line includes a second accumulator chamber for storing the leaked fuel at a predetermined pressure and a valve provided at an exit of the second accumulator chamber to adjust an amount of fuel to be discharged from the control chamber.

8. The fuel injection system of claim 7, wherein the valve is a duty control solenoid valve.

* * * * *